US010950380B2

(12) United States Patent
Choi et al.

(10) Patent No.: US 10,950,380 B2
(45) Date of Patent: Mar. 16, 2021

(54) COIL ELECTRONIC COMPONENT AND METHOD OF MANUFACTURING THE SAME

(71) Applicant: SAMSUNG ELECTRO-MECHANICS CO., LTD., Suwon-si (KR)

(72) Inventors: Woon Chul Choi, Suwon-si (KR); Ji Hye Oh, Suwon-si (KR); Jung Hyuk Jung, Suwon-si (KR); Han Wool Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/540,708

(22) Filed: Aug. 14, 2019

(65) Prior Publication Data

US 2019/0371508 A1 Dec. 5, 2019

Related U.S. Application Data

(63) Continuation of application No. 15/253,130, filed on Aug. 31, 2016, now Pat. No. 10,431,368.

(30) Foreign Application Priority Data

Dec. 30, 2015 (KR) ..... 10-2015-0189279

(51) Int. Cl.
*H01F 27/28* (2006.01)
*H01F 27/02* (2006.01)
(Continued)

(52) U.S. Cl.
CPC ..... *H01F 27/022* (2013.01); *H01F 27/245* (2013.01); *H01F 27/255* (2013.01);
(Continued)

(58) Field of Classification Search
CPC ..... H01F 17/0006; H01F 2017/0048; H01F 27/022; H01F 27/245; H01F 27/255;
(Continued)

(56) References Cited

U.S. PATENT DOCUMENTS 7,759,776 B2 7/2010 Cheng
9,595,384 B2 3/2017 Nakamura et al.
(Continued)

FOREIGN PATENT DOCUMENTS

CN 1523617 A 8/2004
CN 101046482 A 10/2007
(Continued)

OTHER PUBLICATIONS

Office Action issued in corresponding Korean Patent Application No. 10-2015-0189279 dated Jan. 2, 2020, with English translation.
(Continued)

*Primary Examiner* — Mang Tin Bik Lian
(74) *Attorney, Agent, or Firm* — Morgan, Lewis & Bockius LLP

(57) ABSTRACT

A coil electronic component includes a magnetic body, wherein the magnetic body includes a substrate, and a coil part including patterned insulating films disposed on the substrate, a first plating layer formed between the patterned insulating films by plating, and a second plating layer disposed on the first plating layer.

9 Claims, 7 Drawing Sheets

(51) Int. Cl.

| | |
|---|---|
| ***H01F 27/245*** | (2006.01) |
| ***H01F 27/255*** | (2006.01) |
| ***H01F 41/02*** | (2006.01) |
| ***H01F 41/12*** | (2006.01) |
| ***H01F 41/16*** | (2006.01) |
| ***H01F 41/34*** | (2006.01) |

(52) U.S. Cl.
CPC ..... *H01F 27/2804* (2013.01); *H01F 41/0233* (2013.01); *H01F 41/12* (2013.01); *H01F 41/16* (2013.01); *H01F 41/34* (2013.01)

(58) Field of Classification Search
CPC .. H01F 27/2804; H01F 27/323; H01F 27/324; H01F 41/0233; H01F 41/34; H01F 41/12; H01F 41/16
USPC ..... 336/200, 223, 233
See application file for complete search history.

(56) References Cited

U.S. PATENT DOCUMENTS

| | | | | |
|---|---|---|---|---|
| 9,945,042 | B2 | 4/2018 | Cha et al. | |
| 2004/0164835 | A1* | 8/2004 | Shoji | H01F 17/0013 336/200 |
| 2004/0217440 | A1* | 11/2004 | Ng | H01L 23/5227 257/528 |
| 2005/0195062 | A1 | 9/2005 | Yoshida et al. | |
| 2006/0186978 | A1 | 8/2006 | Kawarai | |
| 2007/0230042 | A1 | 10/2007 | Fujiwara | |
| 2007/0235873 | A1 | 10/2007 | Cheng | |
| 2008/0060185 | A1 | 3/2008 | Han | |
| 2011/0310579 | A1* | 12/2011 | Smeys | H01F 17/04 361/782 |
| 2013/0300529 | A1 | 11/2013 | Chang et al. | |
| 2013/0335186 | A1* | 12/2013 | Chang | H01F 27/292 336/200 |
| 2014/0009254 | A1* | 1/2014 | Ohkubo | H01F 27/29 336/192 |
| 2014/0167897 | A1 | 6/2014 | Choi et al. | |
| 2014/0247101 | A1 | 9/2014 | Cha et al. | |
| 2014/0266547 | A1 | 9/2014 | Watanabe et al. | |
| 2015/0035634 | A1* | 2/2015 | Nakamura | H01F 41/046 336/170 |
| 2015/0035640 | A1 | 2/2015 | Wang et al. | |
| 2015/0048918 | A1 | 2/2015 | Park et al. | |
| 2015/0109088 | A1 | 4/2015 | Kim et al. | |
| 2015/0123757 | A1 | 5/2015 | Choi | |
| 2015/0270053 | A1 | 9/2015 | Cha et al. | |
| 2016/0351316 | A1* | 12/2016 | Ohkubo | H01F 27/325 |

FOREIGN PATENT DOCUMENTS

| | | | |
|---|---|---|---|
| CN | 101071679 | A | 11/2007 |
| CN | 101145511 | A | 3/2008 |
| CN | 103377811 | A | 10/2013 |
| CN | 104051125 | A | 9/2014 |
| CN | 104376954 | A | 2/2015 |
| CN | 104575937 | A | 4/2015 |
| CN | 104733155 | A | 6/2015 |
| CN | 104934187 | A | 9/2015 |
| JP | 10-241983 | A | 9/1998 |
| JP | 2004-253430 | A | 9/2004 |
| JP | 2006-066830 | A | 3/2006 |
| JP | 2006-278479 | A | 10/2006 |
| JP | 2008-166455 | A | 7/2008 |
| JP | 2015-32625 | A | 2/2015 |
| KR | 10-1474166 | B1 | 12/2014 |
| KR | 10-2015-0108518 | A | 9/2015 |

OTHER PUBLICATIONS

Office Action issued in Chinese Patent Application No. 201610848885.X dated Apr. 12, 2019, with English translation.
Second Office Action issued in Chinese Patent Application No. 201610848885.X dated Sep. 30, 2018.
Notice of Allowance issued in related U.S. Appl. No. 15/253,130 dated May 22, 2019.
Non-Final Office Action issued in related U.S. Appl. No. 15/253,130 dated Jan. 24, 2019.
Final Office Action issued in related U.S. Appl. No. 15/253,130 dated Oct. 19, 2018.
Non-Final Office Action issued in related U.S. Appl. No. 15/253,130 dated Jun. 12, 2018.
Office Action issued in Chinese Patent Application No. 201610848885.X dated Feb. 23, 2018.

* cited by examiner

COIL ELECTRONIC COMPONENT AND METHOD OF MANUFACTURING THE SAME

CROSS-REFERENCE TO RELATED APPLICATION

This application is the Continuation Application of U.S. patent application Ser. No. 15/253,130, filed on Aug. 31, 2016, which claims the benefit of priority to Korean Patent Application No. 10-2015-0189279, filed on Dec. 30, 2015 with the Korean Intellectual Property Office, the entirety of which is incorporated herein by reference.

BACKGROUND

The present disclosure relates to a coil electronic component and a method of manufacturing the same.

An inductor, which is a type of chip electronic component, is a representative passive element configuring an electronic circuit together with a resistor and a capacitor to remove noise therefrom.

A thin film type inductor may be manufactured by forming internal coil parts through plating, hardening a magnetic powder-resin composite in which magnetic powders and a resin are mixed with each other to manufacture a magnetic body, and then forming external electrodes on outer surfaces of the magnetic body.

A direct current (DC) resistance (Rdc), which is one of the main properties of the inductor, may be decreased as a cross-sectional area of an internal coil part is increased. In addition, inductance of the inductor may be increased as an area of the magnetic material through which magnetic flux passes is increased.

Therefore, in order to decrease the DC resistance (Rdc) and improve the inductance, the cross-sectional area of an internal coil and the area of a magnetic material may be increased.

Examples of a method for increasing the cross-sectional area of the internal coil part may include a method of increasing a width of the coil and a method of increasing a thickness of the coil.

However, when the width of the coil is increased, there is an increased risk of generating a short circuit between neighboring coils, and a limit to the number of turns of an implementable coil may occur, causing the area of the magnetic material to deteriorate with regard to efficiency. Furthermore, there may be a limitation with regard to implementation for a high capacity product.

Therefore, the thickness and width of a coil should be increased to give an internal coil part of the structure a high aspect ratio (AR).

An aspect ratio (AR) of an internal coil part may mean a value obtained by dividing the thickness of the coil by the width of the coil. As the thickness of the coil is increased by a greater amount than the width of the coil is increased, the higher aspect ratio (AR) may be implemented.

However, when the coil part is formed by performing a pattern plating method in which a plating resist is patterned and plated by an exposure and development process according to the related art, in order to increase the thickness of the coil, a thickness of the plating resist also needs to be increased. Since there is a limitation of the exposure process in which a lower portion of the plating resist is not smoothly exposed as the thickness of the plating resist is increased in thickness, it may be difficult to increase the thickness of the coil.

In addition, in order to maintain a form of the thick plating resist, the plating resist needs to have a predetermined width or greater. Since the width of the plating resist corresponds to an interval between the neighboring coils, the interval between the neighboring coils may be increased. As a result, there is a limitation in improving DC resistance (Rdc) and inductance (Ls) characteristics.

In the related art, a process is disclosed in which a first plating conductor pattern is formed after a first resist pattern is formed by exposing and developing a resist film, and a second plating conductor pattern is formed after forming a second resist pattern by again exposing and developing the first plating conductor pattern onto the first resist pattern, in order to solve an exposure limitation according to a thickness of the resist film.

When the internal coil part is formed by performing only the pattern plating method, however, there is a limitation in increasing the cross-sectional area of the internal coil part. Furthermore, since the interval between the neighboring coils is increased, it is difficult to improve DC resistance (Rdc) and inductance (Ls) characteristics.

In addition, in order to form the coil part of the structure having the high aspect ratio (AR), a method of implementing the coil part by adding anisotropic plating onto a plating layer by isotropic plating has been generally attempted.

The above-mentioned anisotropic plating scheme may implement the remaining height of the coil required after forming a seed pattern by the anisotropic plating. According to the above-mentioned scheme, since a shape of the coil, which is a fan shape, has decreased uniformity, it may affect a distribution of the DC resistance (Rdc).

In addition, according to the above-mentioned scheme, since the shape of the coil is bent, it may be difficult to form an insulating layer on the coil pattern. Therefore, a non-insulating space between the coil patterns may occur, thereby causing a defect.

SUMMARY

An aspect of the present disclosure provides a coil electronic component capable of implementing low direct current (DC) resistance (Rdc) by allowing a thickness difference between coil parts to be uniform, and a method of manufacturing the same.

According to an aspect of the present disclosure, a coil electronic component includes a magnetic body. The magnetic body includes a substrate, and a coil part including patterned insulating films disposed on the substrate, a first plating layer formed between the patterned insulating films by plating, and a second plating layer disposed on the first plating layer.

According to another aspect of the present disclosure, a method of manufacturing a coil electronic component includes patterning a base conductor layer on a substrate; patterning insulating films so that the base conductor layer is exposed; forming a first plating layer between the patterned insulating films by performing plating in regard to the base conductor layer; forming a second plating layer by performing anisotropic plating on the first plating layer; and forming a magnetic body by stacking magnetic sheets on and below the substrate on which the insulating films and the first and second plating layers are formed.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
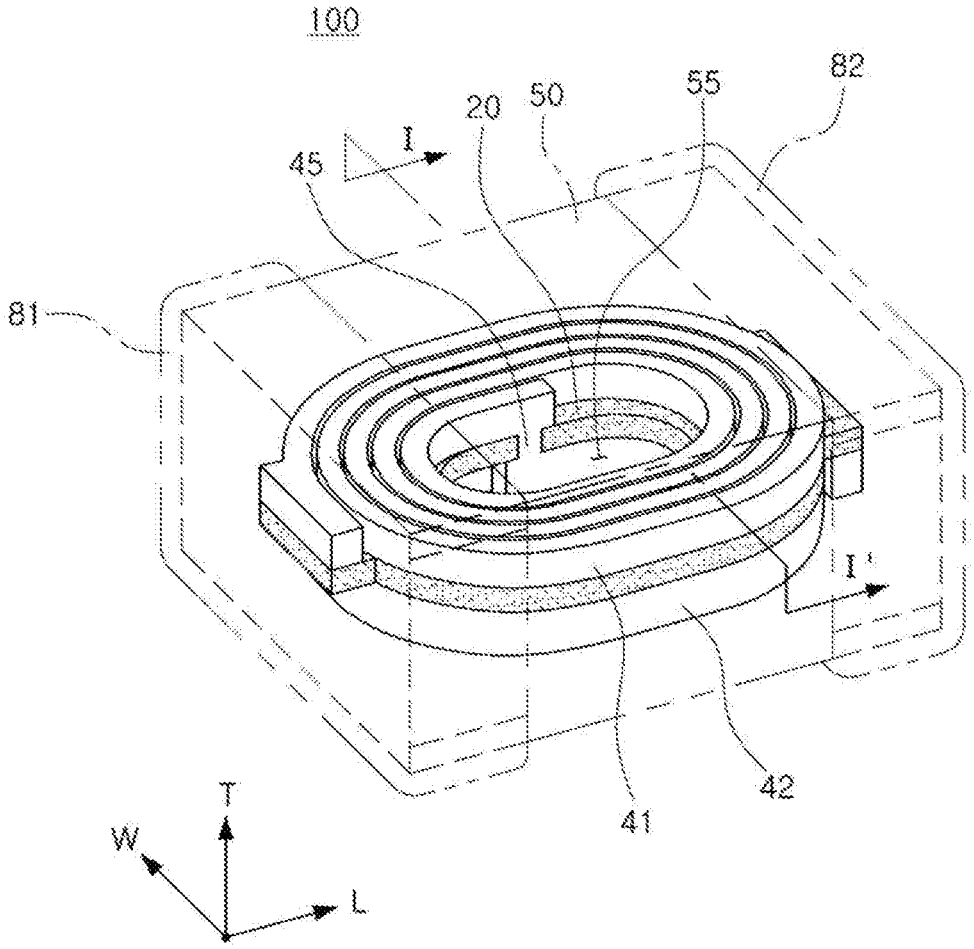
FIG. 1 is a schematic perspective view showing an internal coil part of a coil electronic component according to an exemplary embodiment in the present disclosure so that the internal coil part of the coil electronic component is visible.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Coil Electronic Component

FIG. 1 is a schematic perspective view showing a coil electronic component according to an exemplary embodiment in the present disclosure so that the internal coil part of the coil electronic component is visible.

Referring to FIG. 1, as an example of a coil electronic component 100, a thin film type inductor used in a power line of a power supply circuit is disclosed.

A coil electronic component 100 according to an exemplary embodiment in the present disclosure may include a magnetic body 50, first and second coil parts 41 and 42 embedded in the magnetic body 50, and first and second external electrodes 81 and 82 disposed on outer surfaces of the magnetic body 50 and electrically connected to the first and second coil parts 41 and 42, respectively.

In the coil electronic component 100 according to the exemplary embodiment, a "length direction" refers to an "L" direction of FIG. 1, a "width direction" refers to a "W" direction of FIG. 1, and a "thickness direction" refers to a "T" direction of FIG. 1.

The magnetic body 50 may form the external appearance of the coil electronic component 100, and may be formed of any material without being limited as long as the material exhibits magnetic properties. For example, the magnetic body 50 may be formed by providing a ferrite or a magnetic metal powder.

The ferrite may be, for example, an Mn—Zn based ferrite, a Ni—Zn based ferrite, a Ni—Zn—Cu based ferrite, an Mn—Mg based ferrite, a Ba-based ferrite, a Li-based ferrite, or the like.

The magnetic metal powder may include any one or more selected from the group consisting of iron (Fe), silicon (Si), chromium (Cr), aluminum (Al), and nickel (Ni). For example, the magnetic metal powder may include an Fe—Si—B—Cr based amorphous metal, but is not limited thereto.

The magnetic metal powder may have a particle diameter of 0.1 μm to 30 μm, and may be contained in a form in which it is dispersed in an epoxy resin or a thermosetting resin such as polyimide, or the like.

A first coil part 41 having a coil shape may be formed on a first surface of a substrate 20 disposed in the magnetic body 50, and a second coil part 42 having a coil shape may be formed on a second surface of the substrate 20 opposing the first surface of the substrate 20.

The first and second coil parts 41 and 42 may be formed by performing electroplating.

The substrate 20 may be formed of, for example, a polypropylene glycol (PPG) substrate, a ferrite substrate, a metal based soft magnetic substrate, or the like.

A central portion of the substrate 20 may be penetrated to form a hole, and the hole may be filled with a magnetic material to form a core part 55. Inductance Ls may be improved when the core part 55 is filled with the magnetic material.

The first and second coil parts 41 and 42 may be formed to have a spiral shape, and the first and second coil parts 41 and 42 formed on the first and second surfaces of the substrate 20 may be electrically connected to each other through a via 45 formed to penetrate through the substrate 20.

The first and second coil parts 41 and 42 and the via 45 may include a metal having excellent electrical conductivity. For example, the first and second coil parts 41 and 42 and the via 45 may contain silver (Ag), palladium (Pd), aluminum (Al), nickel (Ni), titanium (Ti), gold (Au), copper (Cu), platinum (Pt), or alloys thereof.

According to an exemplary embodiment in the present disclosure, a coil part has a structure with a high aspect ratio (AR) using isotropic plating having a small thickness distribution, and further increasing the aspect ratio (AR) by adding anisotropic plating on the isotropic plating layer.

Figure 2:
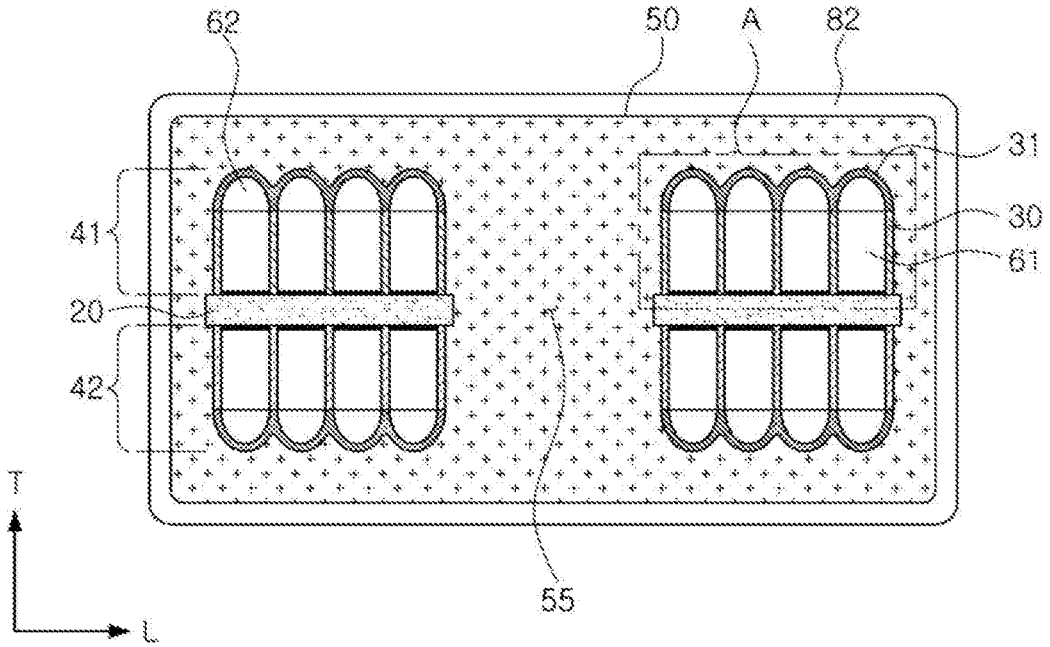
FIG. 2 is a cross-sectional view taken along line I-I' of FIG. 1.

FIG. 2 is a cross-sectional view taken along line I-I' of FIG. 1.

Referring to FIG. 2, the coil electronic component according to an exemplary embodiment may include the magnetic body 50, wherein the magnetic body 50 may include the substrate 20, the coil parts 41 and 42 including patterned insulating films 30 disposed on the substrate 20, a first plating layer 61 formed between the patterned insulating films 30 by plating, and a second plating layer 62 disposed on the first plating layer 61.

The first plating layer 61 may be formed by isotropic plating having a small thickness distribution, and may be formed by a single plating.

Since the first plating layer 61 is formed by a single plating, an internal interface appearing when the first plating layer 61 is formed by two or more platings, that is, at least one internal interface partitioning the plating layer into two layers or more, does not appear.

The internal interface may cause deterioration of DC resistance (Rdc) characteristics and electrical characteristics in the coil electronic component.

Thus, according to an exemplary embodiment, since the first plating layer 61 is formed by a single plating, DC resistance (Rdc) characteristics and electrical characteristics may be improved.

However, the configuration of the first plating layer 61 is not limited thereto, and the first plating layer 61 may also be configured as various plating layers.

The first plating layer 61 may be formed by isotropic plating having a small thickness distribution, wherein the isotropic plating may mean a plating method in which a width and a thickness of the plating layer are simultaneously grown, and is a technology which is in contrast with an anisotropic plating method in which growth speeds of the plating in a width direction of the plating layer and a thickness direction thereof are different.

In addition, since the first plating layer 61 is formed between the patterned insulating films 30 by the isotropic plating, a shape thereof may be a rectangular shape. However, the shape of the first plating layer 61 may be slightly modified by process variation.

Since the first plating layer 61 has a rectangular shape, a cross-sectional area of the coil part may be increased and an area of the magnetic material may be increased, thereby reducing DC resistance (Rdc) and improving inductance.

Further, since a ratio of a thickness to a width of the coil part is increased, a structure having a high aspect ratio (AR) may be implemented, thereby increasing the cross-sectional area of the coil part and improving DC resistance (Rdc) characteristics.

According to an exemplary embodiment, the magnetic body 50 may include the patterned insulating films 30 disposed on the substrate 20.

In the case of a general coil electronic component, after the coil part is formed on the substrate, an insulating film may be formed to cover the coil part.

However, according to an exemplary embodiment, in order to implement low DC resistance (Rdc) by allowing a thickness difference of the coil part to be uniform and reduce defects in which the insulating layer is not formed in a space between the coil patterns by straightly forming the coil part without being bent, the insulating films 30 may be patterned on the substrate 20 before forming the first plating layer 61.

Specifically, by patterning the insulating films 30 to have a narrow width and a thick thickness so that the first plating layer 61 has the high aspect ratio (AR), the isotropic plating process may be performed between the patterned insulating films 30, thereby implementing the first plating layer 61 having the high aspect ratio (AR).

The insulating films 30, which are photosensitive insulating films, may be, for example, formed of an epoxy based material, but are not limited thereto.

In addition, the insulating films 30 may be formed by an exposure and development process of a photo resist (PR).

The first plating layer 61 configuring the coil parts 41 and 42 may not be directly in contact with a magnetic material forming the magnetic body 50 due to the patterned insulating films 30.

A detailed process of forming the patterned insulating films 30 and the first plating layer 61 disposed between the patterned insulating films 30 according to an exemplary embodiment will be described below.

According to an exemplary embodiment, the second plating layer 62 may be disposed on the first plating layer 61.

The second plating layer 62 may be an anisotropic plating layer formed by an anisotropic plating method in which growth speeds of plating in a width direction of the second plating layer 62 and a thickness direction thereof are different.

The second plating layer 62, which is the anisotropic plating layer, may be a plating layer of which a growth in the width direction is suppressed and a growth in the thickness direction thereof is significantly large.

As such, the second plating layer 62, which is the anisotropic plating layer, is further formed on the first plating layer 61, which is the isotropic plating layer, and thus the internal coil parts 41 and 42 having a higher aspect ratio (AR) may be implemented and DC resistance (Rdc) characteristics may be further improved.

The second plating layer 62, which is the anisotropic plating layer, may be formed by adjusting current density, concentration of a plating solution, plating speed, or the like.

As an upper portion of the second plating layer 62 has a round shape or a curved shape, a cover insulating layer 31 disposed on the insulating films 30 and the second plating layer 62 may be formed depending on a surface shape of the second plating layer 62.

According to an exemplary embodiment, the magnetic body 50 may further include a cover insulating layer 31 disposed on the insulating films 30 and the second plating layer 62.

The cover insulating layer 31 may be formed of a material different from that of the insulating films 30.

In addition, since the cover insulating layer 31 is formed on the insulating films 30 and the second plating layer 62 after disposing the patterned insulating films 30 and the first plating layer 61 between the patterned insulating films 30, and disposing the second plating layer 62 on the first plating layer 61, the cover insulating layer 31, which is formed of a material different from that of the insulating films 30 and has a shape different from that of the insulating films 30, may be distinguished from the insulating films 30 and the second plating layer 62 by a boundary with the insulating films 30 and the second plating layer 62.

One end portion of the first coil part 41 formed on one surface of the substrate 20 may be exposed to one end surface of the magnetic body 50 in the length L direction of the magnetic body 50, and one end portion of the second coil part 42 formed on the other surface of the substrate 20 may be exposed to the other end surface of the magnetic body 50 in the length L direction of the magnetic body 50.

However, one end portion of each of the first and second coil parts 41 and 42 is not limited thereto. For example, one end portion of each of the first and second coil parts 41 and 42 may be exposed to at least one surface of the magnetic body 50.

The first and second external electrodes 81 and 82 may be formed on outer surfaces of the magnetic body 50 so as to be connected to the first and second coil parts 41 and 42 exposed to the end surfaces of the magnetic body 50, respectively.

Figure 3:
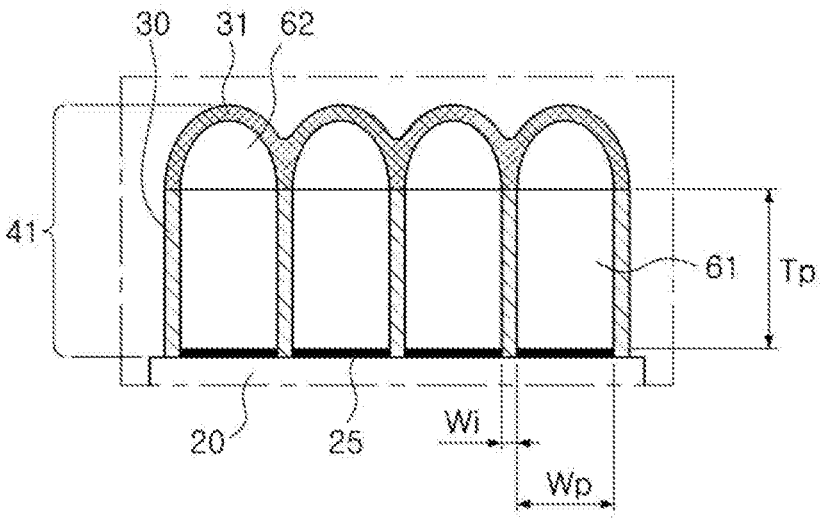
FIG. 3 is an enlarged schematic view of an example of part 'A' of FIG. 2.

FIG. 3 is an enlarged schematic view of an example of part 'A' of FIG. 2.

Referring to FIG. 3, the coil part 41 according to an exemplary embodiment may include the base conductor layers 25 disposed on the substrate 20, the first plating layer 61 disposed on the substrate 20 and formed on the base conductor layers 25 between the patterned insulating films 30 by plating, the second plating layer 62, which is the anisotropic plating layer on the first plating layer 61, and the cover insulating layer 31 disposed on the insulating films 30 and the second plating layer 62.

The base conductor layers 25 may be formed by performing an electroless plating or sputtering method and forming a resist pattern on the substrate 20, and then performing an etching process and a resist delamination process.

A width of the base conductor layer 25 may be 10 μm to 30 μm, but is not limited thereto.

A width of the insulating film 30 may be 1 μm to 20 μm, and a thickness thereof is not particularly limited and may be determined according to a required thickness of the first plating layer 61 formed by isotropic plating.

A method of forming the insulating films 30 is not particularly limited, and may be performed by a general technique of forming a circuit.

A thickness Tp of the first plating layer 61 may be 200 μm or more, and an aspect ratio Tp/Wp thereof may be 1.0 or more.

The first plating layer 61 is formed to have the thickness Tp of 200 μm or more and the aspect ratio Tp/Wp of 1.0 or more, and thus the internal coil parts 41 and 42 having the high aspect ratio (AR) may be implemented.

The first plating layer 61 is formed between the patterned insulating films 30 by the isotropic plating method, and thus an exposure limitation caused by the thickness of the plating resist may be overcome, and the first plating layer 61, which is the isotropic plating layer having a total of thickness Tp of 200 μm or more, may be implemented.

In addition, the aspect ratio Tp/Wp of the first plating layer 61 may be 1.0 or more, but according to an exemplary embodiment, since a width of the first plating layer 61 is similar to that of the base conductor layer 25, the high aspect ratio of 3.0 or more may be implemented.

As such, according to an exemplary embodiment, since the first plating layer 61 is formed on the base conductor layers 25 between the patterned insulating films 30 by the isotropic plating, the coil parts may be straightly formed without being bent, whereby defects in which an insulating layer is not formed in a space between the coil patterns may be reduced.

In addition, since a thickness difference between an outer coil pattern and an inner coil pattern may be formed to be uniform, a cross-section area of the inner coil part may be increased, and DC resistance (Rdc) characteristics may be improved.

The cover insulating layer 31 may be formed by a chemical vapor deposition (CVD) method, a dipping method using a polymer coating solution having low viscosity, or the like, but is not limited thereto.

Method of Manufacturing Coil Electronic Component

FIGS. 4A through 4G are views sequentially illustrating a method of manufacturing a coil electronic component according to an exemplary embodiment in the present disclosure.

Figure 4A:
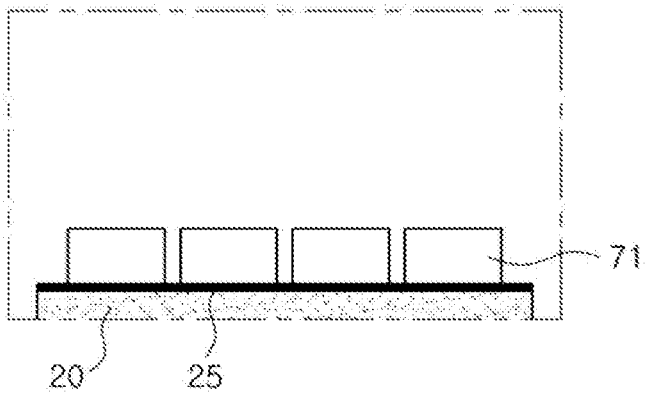
FIGS. 4A through 4G are views sequentially illustrating a method of manufacturing a coil electronic component according to an exemplary embodiment in the present disclosure.
Figure 4B:
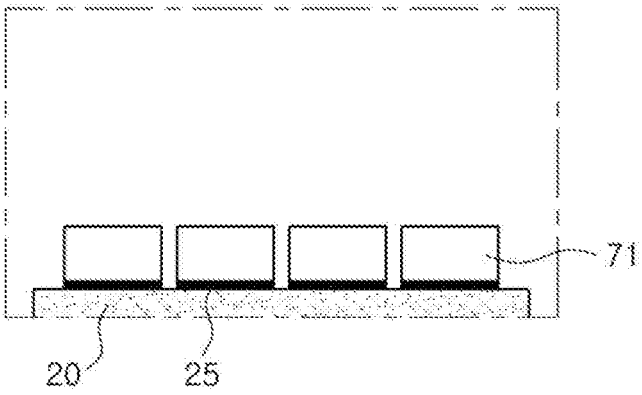
Figure 4C:
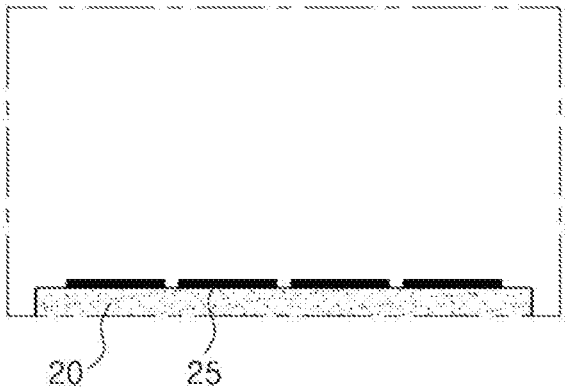

Referring to FIGS. 4A through 4C, a substrate 20 may be prepared, and a base conductor layer 25 may be patterned on the substrate 20.

A via hole (not illustrated) may be formed in the substrate 20, and the via hole may be formed by using a mechanical drill or a laser drill, but is not limited thereto.

The laser drill may be, for example, a $CO_2$ laser or YAG laser.

Specifically, referring to FIG. 4A, after the base conductor layer 25 is formed by performing an electroless plating or sputtering method on the substrate 20, a resist pattern 71 may be formed.

Referring to FIG. 4B, in order to pattern the base conductor layer 25, an etching process may be performed.

Next, as illustrated in FIG. 4C, a patterned base conductor layer 25 may be formed on the substrate 20 by a process of delaminating the resist pattern 71.

A width of the base conductor layer 25 may be 10 μm to 30 μm, but is not limited thereto.

Figure 4D:
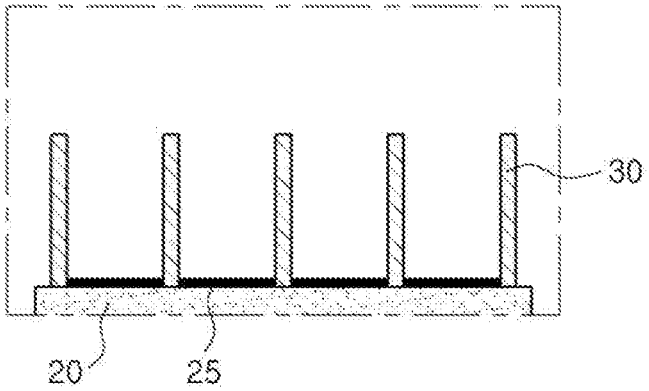

Next, referring to FIG. 4D, patterned insulating films 30 may be formed on the substrate 20.

The insulating films 30 may be formed on the substrate 20 exposed between the patterned base conductor layers 25, to thereby be patterned.

A width Wi of the insulating film 30 may be 1 μm to 20 μm, and a thickness thereof is not particularly limited, and may be determined according to a required thickness of the first plating layer 61 formed by isotropic plating.

A method of forming the insulating films 30 is not particularly limited, and may be performed by a general technique of forming a circuit.

In addition, the insulating films 30 may be photosensitive insulating films. For example, the insulating films 30 may be formed of an epoxy based material, but are not limited thereto.

In addition, the insulating films 30 may be formed by an exposure and development process of a photo resist (PR).

The first plating layer 61 configuring coil parts 41 and 42 formed in a next operation may not be directly in contact with a magnetic material forming the magnetic body 50 due to the patterned insulating films 30.

Since the insulating films 30 serve as a dam of the isotropic plating for forming the first plating layer 61 having a thickness of 200 μm or more, an actual thickness thereof may be 200 μm or more.

Figure 4E:
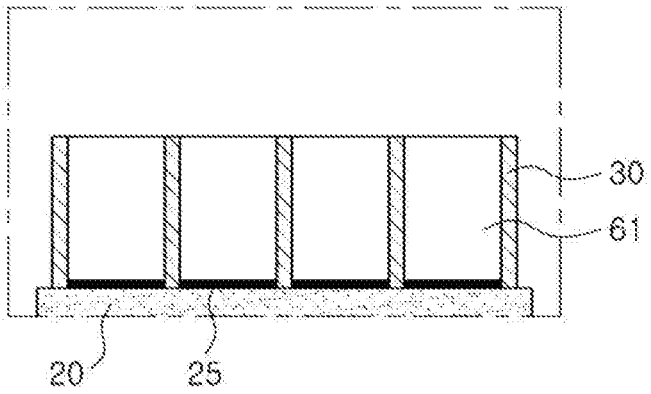

Referring to FIG. 4E, the first plating layer 61 may be formed between the patterned insulating films 30 by an isotropic plating method.

A thickness of the first plating layer 61 may be 200 μm or more.

The first plating layer 61 may have the thickness of 200 μm or more and a high aspect ratio (AR).

The first plating layer 61 is formed between the patterned insulating films 30 by the isotropic plating method, and thus an exposure limitation caused by the thickness of the plating resist may be overcome, and the first plating layer 61 having a total of thickness Tp of 200 μm or more may be implemented.

Figure 4F:
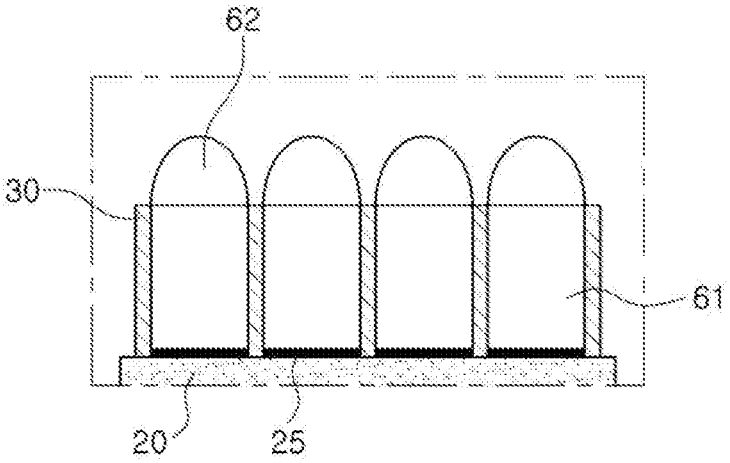

Referring to FIG. 4F, a second plating layer 62 may be formed on the first plating layer 61 by an anisotropic plating method.

A method of forming the second plating layer 62 by the anisotropic plating method may be performed by adjusting current density, concentration of a plating solution, plating speed, or the like.

The second plating layer 62, which is the anisotropic plating layer, may be formed so that a growth in a width direction thereof is suppressed and a growth in a thickness direction thereof is significantly large by adjusting current density, concentration of a plating solution, plating speed, or the like.

The second plating layer 62, which is the anisotropic plating layer, may be formed on the first plating layer 61 to have the aspect ratio Tp/Wp of 1.0 or more, and thus the internal coil parts 41 and 42 having the high aspect ratio (AR) may be implemented.

The first plating layer 61 may be formed between the patterned insulating films 30 by an isotropic plating method, and the second plating layer 62, which is the anisotropic plating layer, may be formed on the first plating layer 61. Thus, an exposure limitation caused by the thickness of the plating resist may be overcome, and the first plating layer 61 and the second plating layer 62 having a total of thickness Tp of 200 μm or more may be implemented.

Figure 4G:
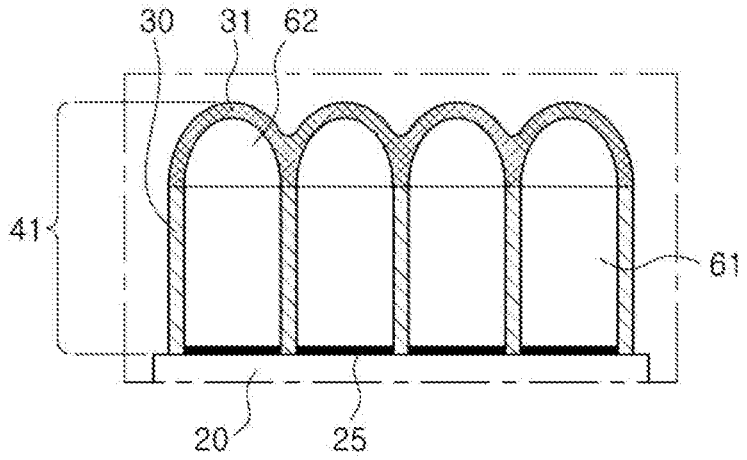

Referring to FIG. 4G, a cover insulating layer 31 may be formed on the insulating films 30 and the second plating layer 62.

The cover insulating layer 31 may be formed of a material different from that of the insulating films 30.

In addition, since the cover insulating layer 31 is formed on the insulating films 30 and the second plating layer 62 after disposing the patterned insulating films 30 and the first plating layer 61 between the patterned insulating films 30, and disposing the second plating layer 62 on the first plating layer 61, the cover insulating layer 31, which is formed of a material different from that of the insulating films 30 and has a shape different from that of the insulating films 30, may be distinguished from the insulating films 30 and the second plating layer 62 by a boundary with the insulating films 30 and the second plating layer 62.

The cover insulating layer 31 may be formed by a screen printing method, a method such as a spray coating process, a chemical vapor deposition (CVD) method, a dipping method using a polymer coating solution having low viscosity, or the like, but is not limited thereto.

In FIGS. 4A through 4F, the base conductor layer 25 is illustrated, but the width thereof is not necessarily equal to those illustrated in FIGS. 4A through 4G, and an actual width thereof may be smaller.

Figure 5:
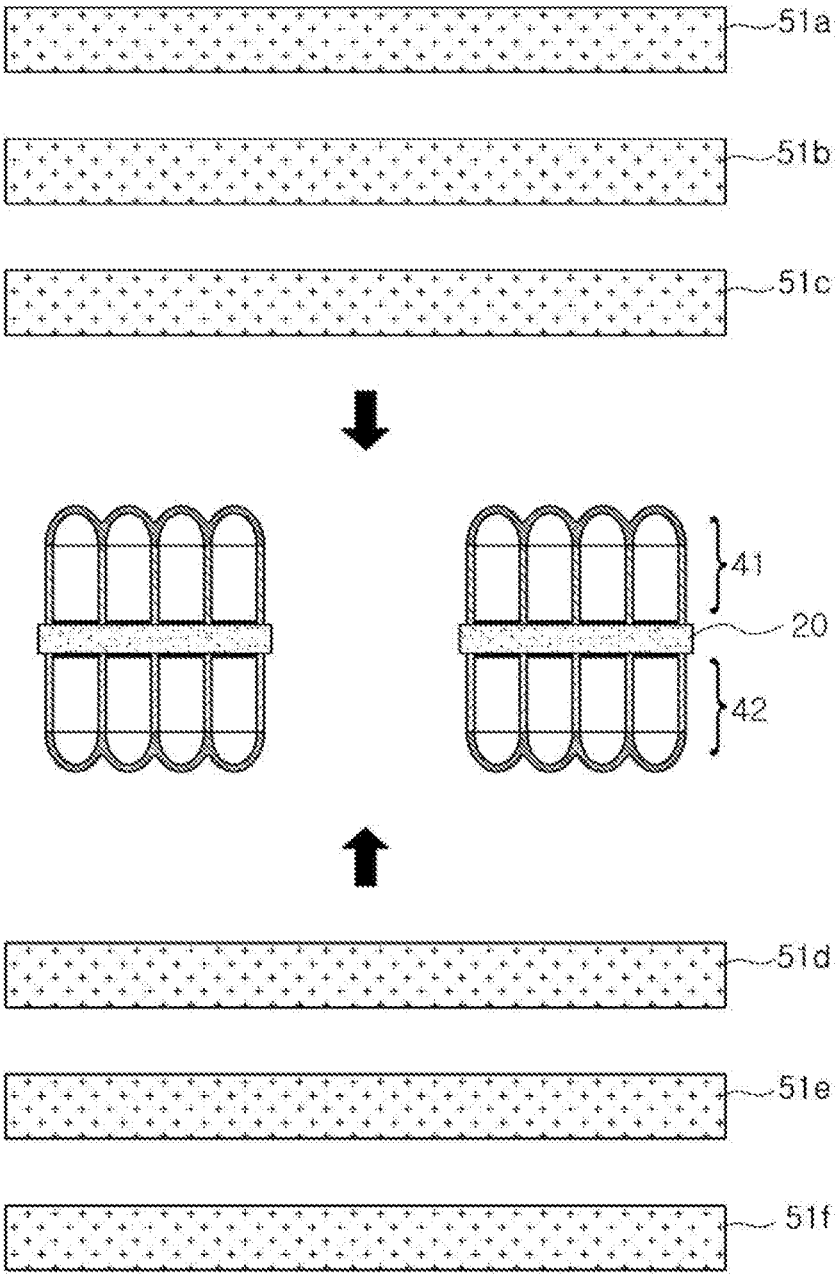
FIG. 5 is a view illustrating a process of forming a magnetic body according to an exemplary embodiment in the present disclosure.

FIG. 5 is a view illustrating a process of forming a magnetic body according to an exemplary embodiment in the present disclosure.

Referring to FIG. 5, magnetic sheets 51*a*, 51*b*, 51*c*, 51*d*, 51*e*, and 51*f* may be stacked on and below the insulating substrate 20 on which the first and second internal coil parts 41 and 42 are formed.

The magnetic sheets 51*a*, 51*b*, 51*c*, 51*d*, 51*e*, and 51*f* may be manufactured in a sheet type by manufacturing a slurry by mixing a magnetic material, for example, magnetic metal powders with organic materials such as a thermosetting resin, and the like, applying the slurry on a carrier film by a doctor blade method, and then drying the applied slurry.

After a plurality of magnetic sheets 51*a*, 51*b*, 51*c*, 51*d*, 51*e*, and 51*f* are stacked, the magnetic body 50 may be formed by compressing and curing the stacked magnetic sheets 51*a*, 51*b*, 51*c*, 51*d*, 51*e*, and 51*f* by a laminate method or a hydrostatic pressing method.

Except for the above-mentioned description, a description of characteristics overlapping those of the coil electronic component according to an exemplary embodiment described above will be omitted.

As set forth above, according to exemplary embodiments in the present disclosure, the coil parts may be straightly formed without being bent, reducing the occurrence of defects such as the insulating layer not being formed in the space between the coil patterns.

According to an exemplary embodiment in the present disclosure, by allowing the thickness difference between the outer coil pattern and the inner coil pattern to be uniform, the cross-section area of the inner coil part may be increased, and DC resistance (Rdc) characteristics may be improved.

Further, in a case in which an anisotropic plating layer is added on the coil parts, a structure having the higher aspect ratio (AR) may be implemented, whereby DC resistance (Rdc) characteristics may be further improved.

While exemplary embodiments have been shown and described above, it will be apparent to those skilled in the art that modifications and variations could be made without departing from the scope of the present invention as defined by the appended claims.

What is claimed is:

1. A coil electronic component comprising:

a magnetic body, wherein the magnetic body includes a substrate, and a coil part including patterned insulating films disposed on a surface of the substrate, a first coil shaped plating layer disposed between the patterned insulating films, a second coil shaped plating layer disposed directly on the first coil shaped plating layer, and a cover insulating layer disposed on the patterned insulating films and the second coil shaped plating layer, and wherein the first coil shaped plating layer is formed not to exceed an upper surface of the patterned insulating films while the second coil shaped plating layer is formed to exceed an upper surface of the patterned insulating films.

2. The coil electronic component of claim 1, wherein the cover insulating layer is formed to follow the shape of the second coil shaped plating layer.

3. The coil electronic component of claim 1, wherein the cover insulating layer is formed of a material different from that of the patterned insulating films.

4. The coil electronic component of claim 1, wherein the first coil shaped plating layer is integrally formed as a single plating layer.

5. The coil electronic component of claim 1, wherein the first coil shaped plating layer has a rectangular shape.

6. The coil electronic component of claim 1, wherein the first coil shaped plating layer has a thickness of 200 μm or more, and an aspect ratio of 1.0 or more.

7. The coil electronic component of claim 1, wherein the patterned insulating films has a width of 1 μm to 20 μm.

8. The coil electronic component of claim 1, wherein the second coil shaped plating layer is an anisotropic plating layer.

9. The coil electronic component of claim 1, wherein a lower surface of the second coil shaped plating layer is arranged at or above the upper surface of the patterned insulating films.

* * * * *